United States Patent [19]

Speranzin

[11] 4,084,766

[45] Apr. 18, 1978

[54] DEVICE TO DISRUPT THE BALLOON OF YARN

[75] Inventor: Claudio Speranzin, Pordenone, Italy

[73] Assignee: Officine Savio, S.p.A., Pordenone, Italy

[21] Appl. No.: 685,179

[22] Filed: May 11, 1976

[30] Foreign Application Priority Data

May 20, 1975 Italy ..... 83378 A/75

[51] Int. Cl.[2] ..... B65H 49/00; D01H 13/04

[52] U.S. Cl. ..... 242/129.62; 57/106

[58] Field of Search ..... 242/128, 129.62, 157 R; 57/106, 108

[56] References Cited

U.S. PATENT DOCUMENTS

| | | | |
|---|---|---|---|
| 676,839 | 6/1901 | Draper | 57/108 |
| 1,860,039 | 5/1932 | Laux | 57/108 |
| 2,654,551 | 10/1953 | Te Strake | 242/128 |

*Primary Examiner*—Leonard D. Christian

*Attorney, Agent, or Firm*—Stevens, Davis, Miller & Mosher

[57] ABSTRACT

A device for disrupting a ballooning yarn which is suitable for coupling to cops being unwound in a winding machine and which comprises a cylindrical section positionable at the side of the cop being unwound and extending at least the whole height of the cop and a loop or thread guide supported by the cylindrical section above the cop. The circular sector is between one and one half and four times the diameter of the cop.

4 Claims, 4 Drawing Figures fig. 3
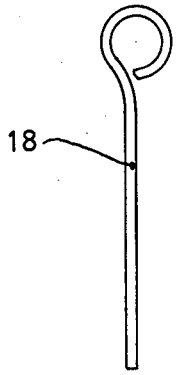
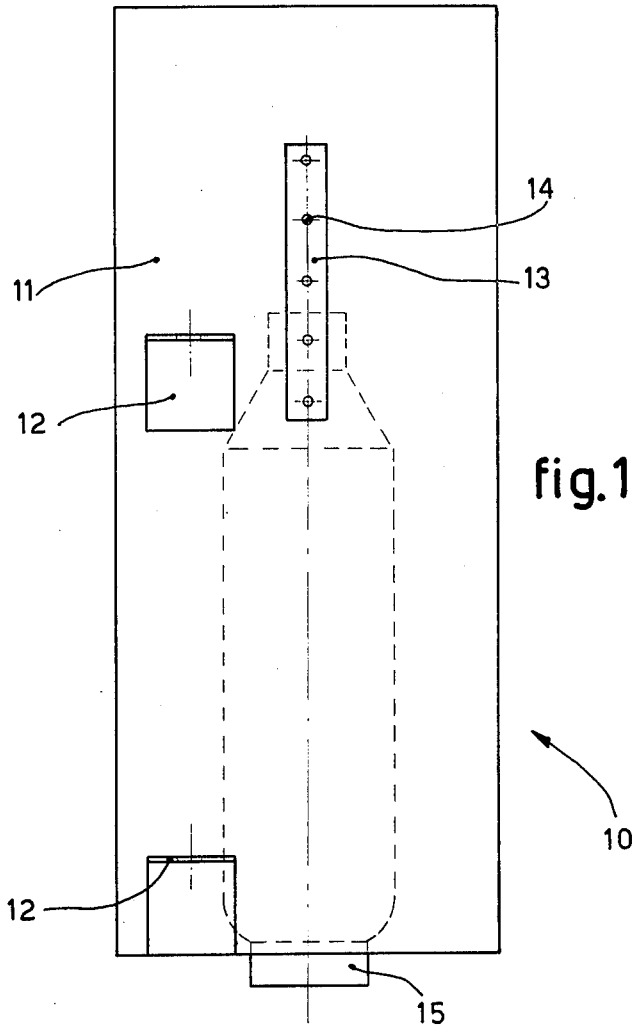
fig. 1
fig. 4
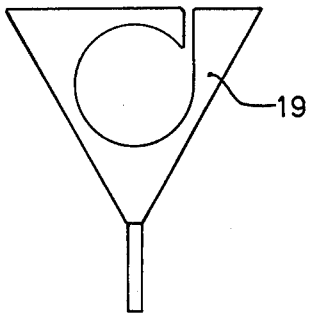
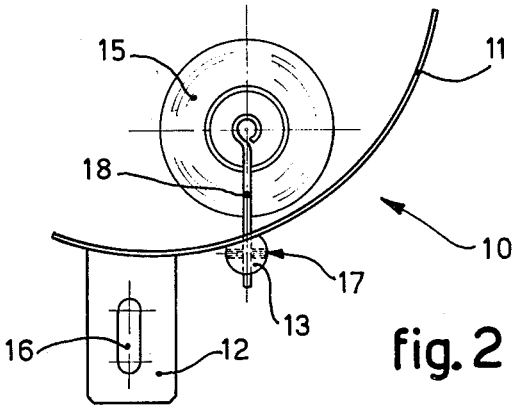
fig. 2

DEVICE TO DISRUPT THE BALLOON OF YARN

This invention relates to a device to disrupt the balloon and which is especially suitable for operating in association with cops being unwound.

To be more exact, the invention relates to a device which cooperates peripherally with the cop being unwound and which is adjustable so as to be adaptable to various types of cops.

Devices to disrupt the balloon of a ring type or loop type are known which have the function of delimiting the size of the balloon itself and of reducing tension.

The invention in question is expressly concerned with applications on winding machines and, in particular, on automatic winding machines wherein the yarn wound into cops is unwound at speeds greater than 600 meters per minute.

In such winding machines and especially in automatic winding machines the automation of the process makes it necessary that any events disturbing the process itself should be reduced to a minimum or obviated.

Known balloon-disrupters make it possible, by means of their action disturbing the balloon, to work with a tension considerably less than that applied in the case of free unwinding. Their action, however, takes place in a limited area generally above the upper end of the cops, and its effects become less during the curse of unwinding, particularly so when the lowest coils are reached.

Moreover, it often happens that with the known balloon-disrupters coils that are still not near the point of being unwound fly off the bobbin.

A further difficulty, which is particularly important in the case of automatic machines, lies in the fact that with the known balloon-disrupters it is not possible to unwind the cop completely and a bottom layer of coils of considerable dimensions often remains on the bobbin. So as to reduce this layer it is necessary to reduce the unwinding speed and hence the output of the machine.

Therefore the present invention tends to enable the unwinding speed of the cop to be increased where conditions are equal, i.e. where the number of knots, of coils flying out of place and of cops whose bottom layers are not unwound is equal.

This invention also tends to improve performance in the case of polyester yarns of fine counts, particularly as regards the bottom layers, and of yarns of large counts, particularly as regards coils flying out of place.

The invention consists of a cylindrical section having a radius one and a half to four times the diameter of the cop. The section is kept close to and at a tangent to a circumferential line surrounding the cop at a distance of about five to ten millimeters.

Advantageously a self-threading, thread-guide loop of a type suited to the type of yarn to be handled is arranged above the cop. In the case of yarns of a fine count a thread-guide loop, the so-called pig tail guide, is preferential, whereas for yarns of a large count or yarns which have a tendency for their coils to fly out of place a thread-guide having a face towards the cop substantially formed like a plane is preferential.

The presence of the thread-guide positioned above the cop performs the function, while the upper part of the cop is being unwound, of creating an auxiliary balloon, which keeps the yarn detached from the bobbin and thus ensures the elimination of increases in tension caused by the beating of the yarn itself against the bobbin.

The symmetrical form of the self-threading thread-guide makes it possible to unwind cops that have been wound in a clockwise or anti-clockwise direction by simply rotating the thread-guide itself through 180°.

Both the reciprocal position cop/balloon-disrupter and the reciprocal position cop/thread-guide can be adjusted as necessary, depending on the yarn and the unwinding parameters.

The invention is displayed as being a balloon-disrupter suitable for cops being unwound in a winding machine and preferentially in an automatic winding machine. The balloon-disrupter is characterized by the fact that it consists of a cylindrical section having a radius of from one and a half times to four times the diameter of the cop and encloses, within the angle subtending a sector of said section, an area equal to from one and a half to three cross-sectional areas of cops disposed peripherally within it. Also the balloon-disrupter advantageously has a thread-guide positioned above the cop.

Further advantages of the invention will become apparent from the following description which is given as a non-limitative example and wherein:

FIG. 1 shows a rear elevation view;

FIG. 2 shows a top plan view; and

FIGS. 3 and 4 are diagrammatic views which show two preferential thread-guides.

In FIG. 1 10 is generically the balloon-disrupter, 11 is the cylindrical section which performs the primary function of a balloon-disrupter, 12 are adjustable supports having holes 16 therein suitable for enabling the reciprocal positioning of the balloon-disrupter 10 and the cop 15. 13 is a support which is disposed in a substantially vertical manner on section 11 and which includes some holes 14 equipped with clamping means, for example screw means 17. Support 13 serves to sustain the thread-guiding loop 18 or 19 or of yet another type, depending on the type of yarn to be handled. The plurality of holes 14 serves to enable the position of the loop to be adjusted to suit the height of the cop. 15 is the cop of any desired type and size.

The loop 19 has at least one flat face so that, when the yarn flies off and draws some coils with it, the coils beat against the flat face turned towards the cop and are unable to straddle the thread-guide 19 and to become entangled thereon. Besides performing the aforesaid functions, the shape of the balloon-disrupter enables the invention to be used also in those automatic machines, for instance automatic winding machines, wherein the cops are loaded from the side with the help, for instance, of a rotating circular table.

In accordance with the invention cop 15 should be positioned more than ten/twelve millimeters and not less than four/five millimeters from section 11. This has the effect that the yarn being unwound is flattened and raised at each pass. A bearing action occurs which always prevents the coils from being drawn off and the yarn from being rolled on the bobbin whenever the yarn on the bobbin is almost wholly unwound and only the bottom layers remain thereon. Moreover the tangential departure of the yarn before and after each pass permits a gradual beginning and ending of the balloon and an auxiliary, periodic tensioning of the unwinding yarn takes place.

Given an equal number of knots, of coils flying off the bobbin and of cops whose inner layers are not usable, this beating action enables the speed to be increased by 10% to 35%, depending on the yarn, a normal increase being about 20% to 25%. The presence of the loop 18 or 19 or of another type above the cop, said loop being of an automatic threading type and being preferentially reversible so as to permit cops wound clockwise or anti-clockwise to be unwound, has the purpose of enlarging and disturbing the balloon. The joint action of the loop and the cylindrical section lessens the tension since rubbing against the bobbin ceases.

Moreover, when the lower layers of yarn on the bobbin are reached, the beating action produced on the balloon improves the unwinding of said lower layers. Next, the loop 18 is especially important in the case of yarns of a fine count where the yarn would tend to beat and the balloon would tend to flatten. Instead, the loop enlarges the balloon and prevents the yarn from beating. The loop 19, on the other hand, is suitable for yarns of a large count since with such yarns there is always a tendency for the coils to fly out of place. Besides displacing and enlarging the balloon, the loop 19 does not allow the coils to fly and become entangled on the loop itself.

One particular solution has been described here, but some variants are possible. Thus it is possible to vary the proportions and sizes, to modify the system of fixture of the balloon-disrupter, to modify the system of fixture of the thread-guides and to vary the types of thread-guides. These and other variants are possible without departing thereby from the scope of the inventive idea.

What is claimed is:

1. A device to disrupt the balloon, which is suitable for coupling to cops being unwound in a winding machine, comprising in reciprocal coordination and cooperation a cylindrical section positioned eccentrically to the axis of the cop and extending at least the whole height of said cop, a thread guide, and means mounted on said cylindrical section for adjustably supporting the guide above the cop.

2. The device of claim 1, wherein the axis of the cylindrical section is kept substantially parallel to the axis of the cop.

3. The device of claim 1, wherein the radius of formation of the cylindrical section is between one and a half times and four times the diameter of the cop, said section partly surrounding the cop and having an arc in cross-section of the section of less than 180°.

4. The device of claim 1, wherein the thread-guide has a flat and enlarged contact face which is turned towards the cop.

* * * * *